US005951851A

United States Patent [19]

Poirier et al.

[11] Patent Number: 5,951,851

[45] Date of Patent: Sep. 14, 1999

[54] SULFUR REMOVAL FROM HYDROCARBON FLUIDS BY CONTACTING SAID FLUIDS WITH HYDROLOLCITE-LIKE ADSORBENT MATERIAL

[76] Inventors: Marc-Andre Poirier, 744 Esser Cr., Sarnia, Canada, N7S 5W9; Christian Detellier, 23 Chemin McNally, Alcove, Canada, J0X 1A0

[21] Appl. No.: 08/961,612

[22] Filed: Oct. 31, 1997

[51] Int. Cl.[6] ..... C10G 11/00

[52] U.S. Cl. ..... 208/213

[58] Field of Search ..... 208/207, 213, 208/299

[56] References Cited

U.S. PATENT DOCUMENTS

| | | | |
|---|---|---|---|
| 3,185,641 | 5/1965 | Cowden | 208/226 |
| 4,011,882 | 3/1977 | Nivens et al. | 137/15 |
| 4,149,966 | 4/1979 | O'Donnell et al. | 208/237 |
| 4,248,695 | 2/1981 | Swanson | 208/232 |
| 4,908,122 | 3/1990 | Frame et al. | 208/207 |
| 4,952,382 | 8/1990 | van Broekhoven | 423/244 |
| 5,160,045 | 11/1992 | Falkiner et al. | 210/634 |
| 5,199,978 | 4/1993 | Poirier et al. | 208/233 |
| 5,200,062 | 4/1993 | Poirier et al. | 208/236 |
| 5,250,181 | 10/1993 | Falkiner et al. | 210/634 |
| 5,360,536 | 11/1994 | Nemeth et al. | 208/248 |
| 5,525,233 | 6/1996 | Falkiner et al. | 210/638 |
| 5,618,408 | 4/1997 | Poirier et al. | 208/370 |

FOREIGN PATENT DOCUMENTS

| | | | |
|---|---|---|---|
| wo/9110505 | 7/1991 | United Kingdom | B01J 8/00 |

*Primary Examiner*—Helane Myers
*Attorney, Agent, or Firm*—Joseph J. Allocca

[57] ABSTRACT

Elemental sulfur present in fluids such as refined petroleum products, e.g., gasoline, jet, diesel, kerosene or fuel additives such as ethers, is removed from such fluids by contacting the contaminated fluid with an adsorbent of Mg2AlNO3 or Mg3AlNO3 or by adding to the fluids a quantity of hydrocarbyl mercaptan and passing the resulting mixture through an adsorbent selected from the group consisting of alumina, bayerite, brucite and hydrotalcite like materials of the formula $M_x^{2+}M_y^{3+}(OH)_{2x+3y-z}(NO_3)mH_2O$ wherein $M^{2+}$ is Magnesium, $M^{3+}$ is aluminum, and x, y and z are values from 1 to 6 and m is the number of waters of hydration.

4 Claims, No Drawings

SULFUR REMOVAL FROM HYDROCARBON FLUIDS BY CONTACTING SAID FLUIDS WITH HYDROLOLCITE-LIKE ADSORBENT MATERIAL

BACKGROUND OF THE INVENTION

1. Field of the Invention

This invention relates to a process for removing elemental sulfur from fluids, particularly fuels such as gasoline, jet fuel, diesel, kerosene and fuel additives such as ethers (e.g., MTBE) transported in pipelines which are usually used to transport sour hydrocarbons.

2. Description of the Related Art

It is well known that elemental sulfur and other sulfur compounds contained in hydrocarbon streams are corrosive and damaging to metal equipment, particularly copper and copper alloys. Sulfur and sulfur compounds may be present in varying concentrations in refined fuels and additional contamination may take place as a consequence of transporting the refined fuel through pipelines containing sulfur contaminants resulting from the transportation of sour hydrocarbon streams such as petroleum crudes. The sulfur has a particularly corrosive effect on equipment such as brass valves, gauges and in-tank fuel pump copper commutators.

Various techniques have been reported for removing elemental sulfur from petroleum products. For example U.S. Pat. No. 4,149,966 discloses a method for removing elemental sulfur from refined hydrocarbon fuels by adding an organo-mercaptan compound and a copper compound capable of forming a soluble complex with said mercaptan and said sulfur and contacting said fuel with an adsorbent material to remove the resulting copper complex and substantially all the elemental sulfur.

U.S. Pat. No. 4,908,122 discloses a process for sweetening a sour hydrocarbon fraction containing mercaptans by contacting the hydrocarbon fraction in the presence of an oxidizing agent with a catalytic composite, ammonium hydroxide and a quaternary ammonium salt other than hydroxide.

U.S. Pat. No. 3,185,641 describes a method for removing elemental sulfur from a liquid hydrocarbon which comprises contacting with solid sodium hydroxide a hydrocarbon stream having dissolved therein at least 7.6 parts by weight of water per part of sulfur contained therein to yield both a hydrocarbon phase and an aqueous phase. The method is claimed to be effective and convenient for treating gasoline containing from trace to more than 25 ppm sulfur employing temperatures as high as about 140° F. (60° C.).

U.S. Pat. No. 4,011,882 discloses a method for reducing sulfur contamination of refined hydrocarbon fluids transported in a pipeline for the transportation of sweet and sour hydrocarbon fluids by washing the pipeline with a wash solution containing a mixture of light and heavy amines, a corrosion inhibitor, a surfactant and an alkanol containing from 1 to 6 carbon atoms.

U.S. Pat. No. 5,160,045 discloses a process for removing elemental sulfur from fluids such as gasoline, diesel fuel, jet fuel or octane enhancement additives such as ethers (MTBE), which pick up sulfur when transported through pipelines which are otherwise used for the transport of sour hydrocarbon streams. In that patent the sulfur containing fluid is contacted with an aqueous solution containing caustic, sulfide and optionally elemental sulfur to produce an aqueous layer containing metal polysulfides and a clear fluid layer having a reduced elemental sulfur level. Preferably an organo mercaptan is also mixed with the fluid to accelerate the removal of elemental sulfur. This patent also recites that alcohol such as methanol, ethanol, propanol, ethylene glycol, propylene glycol, etc., may be added to the aqueous caustic mixture which is contacted with the fluid to be treated. The amount of alcohol used may vary within wide limits. In the case of methanol the patent recites that from 0 to about 90 volume percent of the water may be replaced with alcohol.

U.S. Pat. No. 5,199,978 discloses a process for removing elemental sulfur from fluids such as gasoline, diesel fuel, jet fuel or octane enhancement additives such as ethers (MTBE) which pick up sulfur when transported through pipelines which are otherwise used for the transport of sour hydrocarbon streams. In that patent the sulfur containing fluids are mixed with an inorganic caustic material, an alkyl alcohol and an organo mercaptan or inorganic sulfide compound capable of reacting with sulfur to form a fluid insoluble polysulfide salt reaction product at ambient reaction temperatures. The treated fluid is then contacted with an adsorbent or filtered to remove the insoluble salt leaving a fluid product of very low residual sulfur content.

U.S. Pat. No. 4,248,695 is directed to a process for desulfurizing a sulfur containing fuel comprising contacting the fuel with a lower primary alkanol solution containing an alkali metal hydrosulfide at a temperature and pressure from ambient up to the critical temperature of the alkanol solvent, the water content of said solution being below that which will cause said hydrosulfide to decompose into $K_2S$ hydroxide, and separating said fuel from said alkanol solution now containing the corresponding high sulfur content alkali metal polysulfide with the proviso that the volume ratio of said alkanol solution to said fuel is determined by the gram mols of sulfur present in the fuel divided by 1½ gram mols of sulfur, when sodium is the alkali metal, times the molecular weight of sodium hydrosulfide divided by the number of grams of sodium hydrosulfide per milliliter of the alkanol solution and the volume ratio of said alkanol solution to said fuel is determined by the gram mols of sulfur present in the fuel divided by 2 gram mols of sulfur, when potassium is the alkali metal, times the molecular weight of potassium hydrosulfide per milliliter of the alkanol solution. The process can further include the step of adding 10% water to said separated alkanol solution when the alcohol is below boiling temperature to separate the alcohol and the polysulfide from the fuel. As an additional step water in an amount of not more than one half of the volume of the alkanol can be added to dissolve the alkali metal polysulfide to form a concentrated solution in water which separates from the fuel.

U.S. Pat. No. 5,618,408 is directed to a process for reducing the amount of elemental sulfur picked up by a hydrocarbon fluid being transported in a pipeline by reducing or controlling the amount of dissolved oxygen present in the hydrocarbon fluid prior to fluid being introduced into the pipeline. This is accomplished by isolating the fluid from air or oxygen so as to prevent the fluid from becoming contaminated with dissolved oxygen, or, if the fluid is already contaminated with dissolved oxygen, treating the fluid so as to reduce the dissolved oxygen content of the fluid down to about 30 wppm dissolved $O_2$ or less, preferably about 10 wppm dissolved $O_2$ or less. The dissolved $O_2$ content is reduced by washing the $O_2$ contaminated fluid with an oxygen adsorbed such as sodium sulfite or hydrazines or by using sodium sulfite, clay or hydrotalcites as an $O_2$ adsorbent bed.

SUMMARY OF THE INVENTION

The present invention is a process for removing sulfur from hydro-carbonaceous fluids by contacting the sulfur contaminated fluid with layered double hydroxide (or hydrolalcite) $Mg_2AlNO_3$; $mH_2O$ or $Mg_3AlNO_3$; $mH_2O$ where m is the number of waters of hydration. Alternatively fluids contaminated with elemental sulfur can have added to them a quantity of hydrocarbyl mercaptan or conversely fluids contaminated with mercaptans can have added to them a quantity of elemental sulfur, to form a mixture and subsequently the mixture is contacted with an adsorbent selected from the group consisting of alumina, bayerite, brucite, and hydrotalcites of the formula:

$$M_x^{2+}M_y^{3+}(OH)_{2x+3y-z}(NO_3)_z.mH_2O$$

wherein $M^{2+}$ is magnesium, $M^{3+}$ is aluminum, x, y and z are values from 1 to 6 and m is the number of waters of hydration, and mixtures thereof, to thereby remove the sulfur and mercapto compounds from such fluids.

DETAILED DESCRIPTION OF THE INVENTION

The fluids which are treated in accordance with the invention include fluids containing elemental sulfur or mercaptans where the elemental sulfur or mercaptans is (are) detrimental to the performance of the fluid. The invention is particularly applicable to those liquid products which have become contaminated with elemental sulfur as a result of being transported in a pipeline previously used to transport sour hydrocarbon streams such as petroleum crudes.

The fluids treated in accordance with the invention include a wide variety of petroleum fuels and particularly refined hydrocarbon fuels such as gasoline, jet fuel, diesel fuel and kerosene.

Other fluids include ethers used to improve the octane ratings of gasoline. These ethers are typically dialkyl ethers having 1 to 7 carbon atoms in each alkyl group. Illustrative ethers are methyl tertiary-butyl ether, methyl tertiary-amyl ether, methyl tertiary-hexyl ether, ethyl tertiary-butyl ether, n-propyl tertiary-butyl ether, isopropyl tertiary-amyl ether. Mixtures of these ethers and hydrocarbons may also be treated in accordance with the invention.

Still other fluids which can be so treated include liquefied petroleum gas (LPG) and solvents.

The above fluids, when contaminated with elemental sulfur, will have added of them, in accordance with the present invention, a quantity of organo mercaptan sufficient to produce in the fluid a mercaptan to elemental sulfur ratio of about 0.2:1 to 5:1 moles mercaptan to moles of elemental sulfur, preferably 0.2:1 to 2:1 moles mercaptan to moles of elemental sulfur.

Organo mercaptans include alkyl, aryl, alkenyl, cycloalkyl, cyclo-alkenyl, aryl alkyl or alkyl aryl mercaptans. Alkyl groups can contain from 1 to 16 carbon, alkenyl groups can contain 2–16 carbons. Aryl, alkyl aryl and aryl alkyl groups contains 6 to 16 carbons, as appropriate, while cycloalkyl and cycloalkenyl groups contains 5 to 16 carbons, in total.

In those instances in which the hydrocarbon fluid is contaminated with mercaptan, such fluid can be treated by the present invention by addition thereto of sufficient elemental sulfur to produce a final mercapto to elemental sulfur ratio within the above recited limits.

The hydrocarbon fluid containing the elemental sulfur and mercaptan as described above, is contacted with an adsorbent for the removal of the sulfur species (element sulfur and mercaptan).

The adsorbent used is selected from the group consisting of alumina, bayerite, brucite, other anionic materials containing hydroxyl groups, hydrotalcites of the formula $$M_x^{2+}M_y^{3+}(OH)_{2x+3y-z}(NO_3)_z.mH_2O$$

where $M^{2+}$ is magnesium, $M^{3+}$ is aluminum, x, y and z are numbers from 1 to 6 and m is the number of waters of hydration present, and mixtures thereof, preferably alumina, bayerite, brucite and the above described hydrotalcites.

The amount of adsorbent used ranges from about 100 mg to 100 g of adsorbent per liter of hydrocarbonaceous fluid being treated, preferably 500 mg to 20 g of adsorbent per liter of fluid.

The fluid to be treated can be contacted with the absorbent in many different ways, i.e., the adsorbent can be mixed with the fluid, then filtered, or permitted to settle with the supernatant fluid being decanted, the fluid can be passed through a bed of adsorbent, with the adsorbent being in any convenient form, i.e., pellets, powders, performed open grids, etc.

The treating conditions which may be used to carry out the present invention are conventional. Contacting the fluid to be treated is effected at ambient temperature conditions, although higher temperatures up to 35° C. may be employed. Depending upon the volume of fuel to be treated, flow rate, e.g., through a one kilogram adsorbent bed can vary from 0.1 to 3 L per minute. Contact times may vary widely depending on the fluid to be treated, the amount of elemental sulfur therein and the adsorbent materials used. The contact time will be chosen to effect the desired degree of sulfur removal. Contact times under batch treating conditions ranging from 30 seconds to 24 hours more usually 2 to 60 minutes will be usually adequate.

Contacting times under continuous process treating conditions in the absence of added organic mercaptan using a column, expressed as liquid hourly space velocity (LHSV in $hour^{-1}$), of from 0.2 to 3 LHSV, $hour^{-1}$, preferably 1 to 2 LHSV $hour^{-1}$, will be adequate. As demonstrated in Example 4, below, however, in the presence of added organo mercaptan to remove elemental sulfur contaminates (or conversely, in the presence of added elemental sulfur to remove mercaptan contaminants) a higher throughput can be employed, e.g., a rate of 150 to 180 or higher LHSV, $hour^{-1}$ can be used.

EXAMPLES

The following example describes the general procedure for the production of hydrotalcite materials useful in the present invention.

Synthesis of $Mg_6Al_2(OH)_{16}(NO_3)_2\ 4H_2O$

A solution of $Mg(NO_3)_2\ 6H_2O$ (2.4 moles) and $Al(NO_3)_3\ 9H_2O$ (0.8 mole) in 1.28 L of distilled water was slowly added under nitrogen during 90 minutes at room temperature, under a vigorous agitation, to a solution containing sodium nitrate ($NaNO_3$, 0.8 mole) and NaOH 50% (8.19 moles) in 1.6 L of distilled water. At the end of the addition, the reaction mixture was in a gel form. It was then heated to 65–70° C. during 18 hours, washed and vacuum-dried at 125° C.

Gasoline containing 30 mg/L of elemental sulfur was used in the following examples.

The experimental procedure was identical for examples 1 to 3 that follow. 100 mg of powdered adsorbent material was dispersed in 20 mL of gasoline. The mixture was covered and stirred for 18 hours, then, centrifuged. The supernatant was decanted and elemental sulfur content determined by a polarographic method.

The following examples are illustrative of the invention:

Example 1

The following results show that Attapalgus clay, molecular sieve 5 Å, silica gel, alumina, bayerite, tetraphenylphosphonium-montmorillonite, Kao-EG.9.4 Å, Kao-tetraethylene glycol, $Al_{13}$ pillared montmorillonite, tetramethylammonium-montmorillonite, tetrahexylammonium-montmorillonite, sodium-montmorillonite, palygorskite-PFl-s, Kaolinite KGa-I, Kao cellosolve and Iron (III) thiomontmorillonite are ineffective in removing elemental sulfur. However, the hydrotalcites $Al_2LiCl$, $Mg_2AlNO_3$, $Mg_2FeNO_3$, $Mg_3FeNO_3$, $Mg_3AlNO_3$ were particularly effective as shown highlighted in the box below:

| Adsorbent | $S^0$, mg/L in fuel after treatment |
|---|---|
| Molecular sieve 5Å | 30 |
| Attapalgus clay | 30 |
| Silica gel | 29 |
| Alumina | 28 |
| Bayerite | 29 |
| Tetraphenylphosphonium-Montmorillonite | 35 |
| Kao-EG 9.4Å | 31 |
| Kao-tetraethylene glycol | 30 |
| $Al_{13}$ pillared Montmorillonite | 32 |
| Tetramethylammonium-Montmorillonite | 32 |
| Tetrahexylammonium-Montmorillonite | 34 |
| Sodium-Montmorillonite | 32 |
| Palygorskite-PF1-s | 30 |
| Kaolinite KGa-1 | 30 |
| Kao cellosolve | 30 |
| Iron (III) Thiomontmorillonite | 33 |
| $Al_2LiCl$ | 12 |
| $Mg_2AlNO_3$ | 5 |
| $Mg_2FeNO_3$ | 13 |
| $Mg_3FeNO_3$ | 20 |
| $Mg_3AlNO_3$ | 6 |

Example 2

This example shows that not all the hydrotalcites have the same effectiveness in removing elemental sulfur from fuel. Ineffective hydrotalcites were $Zn_2AlNO_3$ and $Mg_2AlCO_3$, shown in the box below:

| Hydrotalcite | $S^0$, mg/L in fuel |
|---|---|
| $Mg_2AlCO_3$ | 29 |
| $Zn_2AlNO_3$ | 32 |
| $Al_2LiCl$ | 12 |
| $Mg_3FeNO_3$ | 20 |
| $Mg_2FeNO_3$ | 13 |
| $Mg_3AlNO_3$ | 6 |
| $Mg_2AlNO_3$ | 5 |

Example 3

This example shows that for the same adsorbent, addition of 106 PrSH:S° (1.39:0.94) mg/L of n-propyl mercaptan to the above fuel significantly improved the elemental sulfur removal. Some adsorbents that were previously ineffective in Example 1 (in box below) were now rendered effective, and the hydrotalcite $Mg_3AlNO_3$ gave exceptionally improved S° removal.

| Adsorbent | n-PrSH mg/L | $S^0$, mg/L in fuel |
|---|---|---|
| Alumina | 0 | 28 |
| Alumina | 106 | 2 |
| Bayerite | 0 | 29 |
| Bayerite | 106 | 5 |
| Brucite | 0 | 22 |
| Brucite | 106 | 4 |
| $Mg_2AlCO_3$ | 0 | 29 |

-continued

| Adsorbent | n-PrSH mg/L | $S^0$, mg/L in fuel |
|---|---|---|
| $Mg_2AlCO_3$ | 106 | 26 |
| $Mg_2AlNO_3$ | 0 | 5 |
| $Mg_2AlNO_3$ | 106 | <1 |
| $Mg_3AlNO_3$ | 0 | 6 |
| $Mg_3AlNO_3$ | 106 | <1 |

Example 4

This example shows that the removal of elemental sulfur from the gasoline can be achieved by adsorption through a column packed with the adsorbent.

In this example, 500 mg of $Mg_2AlNO_3$ (occupying a 0.4 mol volume) was packed in a mini-glass column (0.5 cm internal diameter×2 cm length). 20 ml of gasoline containing 30 mg/L elemental sulfur was percolated through the column. Passage of the entire gasoline sample through the column took about 20 minutes for a LHSV, $hr^{-1}$ of 150. Addition of 106 mg/L n-propyl mercaptan improved significantly the elemental sulfur removal.

| Hydrotalcite | n-PrSH mg/L | $S^o$, mg/L in fuel |
|---|---|---|
| $Mg_2AlNO_3$ | 0 | 25 |
| $Mg_2AlNO_3$ | 106 (1.39:0.94 moles to moles) | 0 |

As is evident, the very high liquid hourly space velocity (LHSV, $hour^{-1}$ of about 150) resulted in a reduced efficiency in elemental sulfur removal using the $Mg_2AlNO_3$ in the absence of any added n-propyl mercaptan, as compared to the level of sulfur removal obtained using the same adsorbent again in the absence of nPrSH, but in the batch contacting made of the Examples above. Thus, to achieve high levels of sulfur removal under continuous process treating conditions (as compared against batch contacting conditions) requires that the fluid to be treated have a relatively long contact time, i.e., a low throughput ratio. It is desirable, therefore, that the throughput rate, expressed as liquid hourly space velocity be on the order of about 0.2 to 3 LHSV, $hour^{-1}$. When organo mercaptan is added, higher space velocities can be employed, e.g., as high as 150 to 180 LHSV, $hour^{-1}$ or higher.

What is claimed is:

1. A method for removing elemental sulfur from hydrocarbonaceous fluids containing elemental sulfur consisting of contacting said fluid with a layered double hydroxide adsorbent material selected from the group consisting essentially of materials of the formula $Mg_2Al(OH)_6NO_3.mH_2O$ and $Mg_3Al(OH)_8NO_3.mH_2O$ where m is the number of waters of hydration to thereby remove the elemental sulfur by adsorption onto the layered double hydroxide adsorbent.

2. The method of claim 1 wherein from about 100 mg to 100 g of layered hydroxide double absorbent material is used per liter of hydrocarbonaceous fluid being treated.

3. The method of claim 1 wherein when contacting is under batch treating condition contact time ranges from 30 seconds to 24 hours.

4. The method of claim 1 wherein when contacting is under continuous process treating conditions, contacting time, expressed on liquid hourly space velocity, ranges from 0.2 to 180 LHSV, $hour^{-1}$ or higher.

* * * * *